US010490009B2

(12) United States Patent
Kwon et al.

(10) Patent No.: US 10,490,009 B2
(45) Date of Patent: Nov. 26, 2019

(54) ELECTRONIC DEVICE FOR CONTROLLING DOOR LOCK AND METHOD THEREOF

(71) Applicant: Samsung Electronics Co., Ltd., Suwon-si, Gyeonggi-do (KR)

(72) Inventors: Hyuk-Joon Kwon, Anyang-si (KR); Hyungil Lee, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/923,988

(22) Filed: Mar. 16, 2018

(65) Prior Publication Data

US 2018/0268633 A1 Sep. 20, 2018

(30) Foreign Application Priority Data

Mar. 16, 2017 (KR) ..... 10-2017-0033047

(51) Int. Cl.
*G07C 9/00* (2006.01)

(52) U.S. Cl.
CPC ..... *G07C 9/00857* (2013.01); *G07C 9/00174* (2013.01); *G07C 9/00309* (2013.01); *G07C 9/00571* (2013.01); *G07C 2009/0088* (2013.01); *G07C 2009/00753* (2013.01); *G07C 2009/00785* (2013.01); *G07C 2009/00801* (2013.01); *G07C 2209/08* (2013.01); *G07C 2209/63* (2013.01)

(58) Field of Classification Search
CPC ..... G07C 9/00174; G07C 9/00309; G07C 9/00571; G07C 9/00857; G07C 9/00896; G07C 2009/00753; G07C 2009/00785; G07C 2009/00801; G07C 2009/0088; G07C 2209/08; G07C 2209/63; H04W 12/06
See application file for complete search history.

(56) References Cited

U.S. PATENT DOCUMENTS

| | | | | |
|---|---|---|---|---|
| 8,943,187 | B1 * | 1/2015 | Saylor | G06F 21/6209 709/223 |
| 9,646,165 | B1 * | 5/2017 | Saylor | G06F 21/6209 |
| 10,075,334 | B1 * | 9/2018 | Kozura | H04L 41/0806 |
| 2002/0099945 | A1 * | 7/2002 | McLintock | G07C 9/00103 713/186 |

(Continued)

FOREIGN PATENT DOCUMENTS

| | | | |
|---|---|---|---|
| JP | 5753066 | B2 | 7/2015 |
| KR | 10-2012-0114460 | A | 10/2012 |

(Continued)

OTHER PUBLICATIONS

European Patent Office, "European Search Report," Application No. EP 18162217.6, dated Aug. 3, 2018, 8 pages.

*Primary Examiner* — Orlando Bousono

(57) ABSTRACT

An electronic device is disclosed. The disclosed electronic device includes a memory for storing a key for unlocking a door lock, a communication module for receiving location information, and a processor electrically connected to the memory and the communication module. The processor reads a plurality of keys from the memory based on the location information received via the communication module, and transmits the read plurality of keys to the door lock sequentially.

20 Claims, 15 Drawing Sheets

(56) References Cited

U.S. PATENT DOCUMENTS

2004/0201449 A1* 10/2004 Denison ..... G07C 9/00309 340/5.23
2005/0088279 A1* 4/2005 Denison ..... G07C 9/00309 340/5.23
2005/0210283 A1* 9/2005 Kato ..... G07O 9/00309 340/5.61
2005/0285716 A1* 12/2005 Denison ..... G06F 21/6209 340/5.2
2006/0007005 A1* 1/2006 Yui ..... G07C 1/10 340/573.4
2006/0097843 A1 5/2006 Libin
2007/0096867 A1* 5/2007 Denison ..... G06F 9/5066 340/5.23
2007/0200671 A1* 8/2007 Kelley ..... B60R 25/257 340/5.72
2007/0296545 A1* 12/2007 Clare ..... G08B 13/14 340/5.64
2009/0051486 A1* 2/2009 Denison ..... G06F 21/6209 340/5.25
2010/0283579 A1* 11/2010 Kraus ..... G07C 9/00944 340/5.7
2011/0025459 A1* 2/2011 Denison ..... G06Q 20/18 340/5.51
2011/0050390 A1* 3/2011 Denison ..... B60R 25/102 340/5.51
2011/0050391 A1* 3/2011 Denison ..... G07C 9/00571 340/5.51
2011/0082882 A1* 4/2011 Denison ..... G07C 9/00571 707/770
2011/0087370 A1* 4/2011 Denison ..... G07C 9/00571 700/236
2011/0156866 A1* 6/2011 Denison ..... B60R 25/102 340/5.54
2011/0187496 A1* 8/2011 Denison ..... G07C 9/00571 340/5.53
2011/0210818 A1* 9/2011 Denison ..... B60R 25/102 340/5.6
2011/0276609 A1* 11/2011 Denison ..... G07C 9/00571 707/812
2011/0289123 A1* 11/2011 Denison ..... G07C 9/00571 707/812
2011/0289124 A1* 11/2011 Denison ..... G07C 9/00571 707/812
2012/0011366 A1* 1/2012 Denison ..... G07C 9/00571 713/170
2012/0011367 A1* 1/2012 Denison ..... G07C 9/00571 713/170
2013/0027177 A1* 1/2013 Denison ..... G07C 9/00571 340/5.23
2013/0187756 A1* 7/2013 Fisher ..... G07C 9/00571 340/5.61
2013/0257590 A1* 10/2013 Kuenzi ..... G05B 1/01 340/5.65
2013/0342314 A1* 12/2013 Chen ..... G07C 9/00309 340/5.65
2014/0282877 A1* 9/2014 Mahaffey ..... H04L 63/0853 726/3
2014/0283018 A1* 9/2014 Dadu ..... G06F 21/70 726/19
2014/0372743 A1* 12/2014 Rogers ..... H04L 9/3234 713/2
2015/0042454 A1 2/2015 Lee
2015/0240531 A1* 8/2015 Blust ..... G07C 9/00571 340/5.5
2015/0287256 A1* 10/2015 Davis ..... G05B 19/02 340/5.25
2016/0035163 A1* 2/2016 Conrad ..... G07C 9/00309 340/5.61
2016/0036594 A1* 2/2016 Conrad ..... H04L 9/3271 713/185
2016/0036788 A1* 2/2016 Conrad ..... G07C 9/00571 713/168
2016/0036814 A1* 2/2016 Conrad ..... H04L 63/0876 713/171
2016/0066254 A1* 3/2016 Colby ..... H04W 4/026 455/41.1
2016/0116510 A1* 4/2016 Kalous ..... G01R 31/392 340/636.1
2016/0300417 A1* 10/2016 Hatton ..... G07C 9/00857
2016/0335438 A1* 11/2016 Dadu ..... G06F 21/70
2016/0337863 A1* 11/2016 Robinson ..... H04W 12/08
2017/0109727 A1* 4/2017 Han ..... G06Q 20/3227
2017/0236353 A1* 8/2017 Conrad ..... G07C 9/00571 713/185
2017/0352210 A1* 12/2017 Maiwand ..... G07C 9/00309
2017/0352214 A1* 12/2017 Maiwand ..... G07C 9/00896
2017/0352215 A1* 12/2017 Maiwand ..... G07C 9/00896

FOREIGN PATENT DOCUMENTS

WO 2014140810 A1 9/2014
WO 2016177666 A1 11/2016
WO 2016177667 A1 11/2016

* cited by examiner

600

| | Door serial | D-key | Type | DRK | Level | Expire Count | Valid Date | Location | Issuer | Group | Name |
|---|---|---|---|---|---|---|---|---|---|---|---|
| 651 | 1 | 12345 | | | | | | A | | Home | Main gate |
| 652 | 2 | 23451 | | | | | | A | | Home | Home gate |
| 653 | 3 | 34512 | | | | | | A | | Home | Room#1 |
| 654 | 4 | 45123 | | | | | | A | | Home | Room#2 |
| 655 | 5 | 54321 | | | | | | A | | Home | Room#3 |
| 656 | 6 | 43215 | | | | | | B | | Car | Car1 |
| 657 | 7 | 32154 | | | | | | C | | Office | Main gate |
| 658 | 8 | 21543 | | | | | | C | | Office | Sub gate |
| 659 | 9 | 15432 | | | | | | C | | Office | Room#4 |
| 660 | 10 | 56789 | | | | | | C | | Office | Room#5 |

FIG.9

ELECTRONIC DEVICE FOR CONTROLLING DOOR LOCK AND METHOD THEREOF

CROSS-REFERENCE TO RELATED APPLICATION AND CLAIM OF PRIORITY

This application is related to and claims priority to Korean Patent Application No. 10-2017-0033047, filed on Mar. 16, 2017, the contents of which are incorporated herein by reference.

TECHNICAL FIELD

Various exemplary embodiments of the present disclosure relate to an electronic device for controlling a door lock and a method thereof.

BACKGROUND

With the recent growth of communication technologies, a technology for unlocking a door lock by generating, from an electronic device, a key capable of unlocking the door lock has been developed. This door lock unlocking system can be utilized in various contexts, such as in a car, a home, an office, and the like. Accordingly, an electronic device can store several types of keys capable of being used in their respective devices and places.

SUMMARY

When a user intends to unlock a specific door lock after storing a plurality of keys capable of unlocking a plurality of door locks in an electronic device, the user can select the key capable of unlocking the corresponding door lock among the plurality of keys, and transmit the selected key to the door lock to unlock the corresponding door lock. When dozens of types of keys have been stored in the electronic device, the user may be inconvenienced by having to remember and transmit an exact key to a door lock so as to unlock the door lock, or repeatedly select and transmit a key until the door lock is unlocked. For instance, when 20 keys have been stored in the electronic device, the user may not be able to unlock the door lock except by trying each key and transmitting the key.

An electronic device according to various exemplary embodiments may read keys having the location information corresponding to location information regarding a door lock among a plurality of keys stored in a memory of the electronic device by utilizing location information, and transmit the read keys to the door lock sequentially to unlock the door lock, thereby unlocking the door lock automatically quickly even without a separate action of a user.

An electronic device according to various exemplary embodiments may include a memory for storing a key for unlocking a door lock, a communication module for receiving location information, and a processor electrically connected to the memory and the communication module. The processor may read a plurality of keys from the memory based on the location information received via the communication module, and transmit the read plurality of keys to the door lock sequentially.

The processor may transmit a key among the plurality of keys to the door lock, receive feedback information corresponding to the key from the door lock, and determine whether to transmit a key subsequent to the key based on the received feedback information.

An electronic device according to various exemplary embodiments may include a memory, a communication module for performing communication with a server, and a processor electrically coupled to the memory and the communication module. The processor may receive a key for unlocking a door lock from the server via the communication module, receive location information via the communication module, and store, in the memory, the key to which the received location information is added.

An electronic device according to various exemplary embodiments may include a communication module for receiving location information, a memory for storing a key for unlocking a door lock, and a processor electrically coupled to the memory and the communication module. The processor may read a first key and a second key from the memory based on the location information received via the communication module, transmit the first key to the door lock, receive feedback information corresponding to the first key from the door lock, and determine whether to transmit the second key based on the feedback information.

A door lock unlocking method of an electronic device according to various exemplary embodiments may include receiving location information, reading a plurality of keys from a memory of the electronic device based on the received location information, and transmitting the read plurality of keys to a door lock sequentially.

The transmitting of the plurality of keys to the door lock sequentially may further include transmitting a key to the door lock, receiving feedback information from the door lock, and determining whether to transmit a subsequent key based on the received feedback information.

A door lock unlocking method of an electronic device according to various exemplary embodiments may include receiving a key for unlocking a door lock from a server, receiving location information via a communication module, and storing, in the memory, the key to which the received location information is added.

A door lock unlocking method of an electronic device according to various exemplary embodiments may include receiving location information via a communication module, reading a first key and a second key from a memory based on the received location information, and transmitting the first key to the door lock, receiving feedback information from the door lock, and determining whether to transmit the second key based on the feedback information.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 9 illustrates an example of a key stored in a memory of an electronic device according to various exemplary embodiments of the present disclosure.

DETAILED DESCRIPTION

Figure 1:
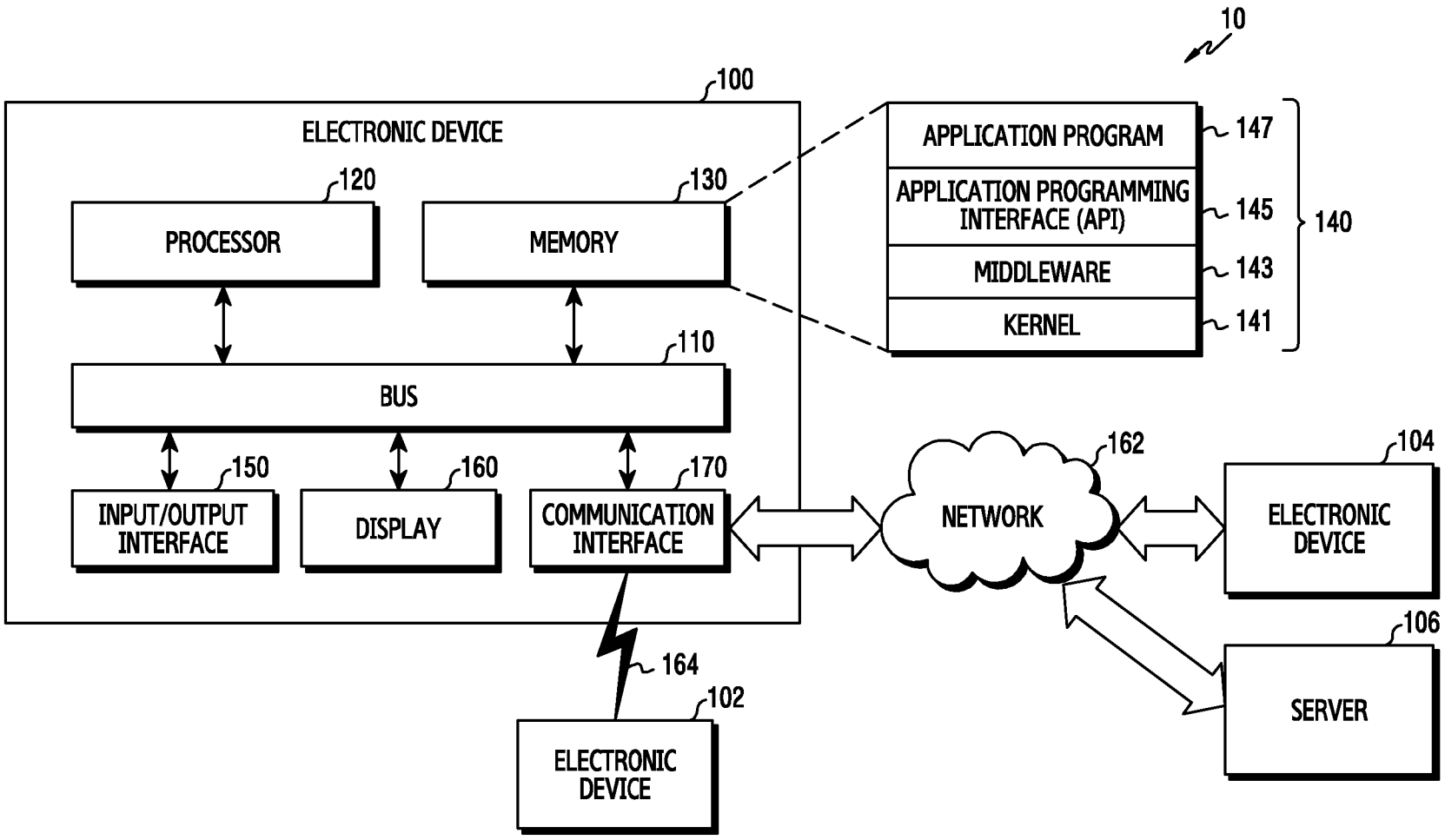
FIG. 1 illustrates an electronic device operating within a network environment according to various embodiments of the present disclosure.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Various embodiments of the present document are mentioned below with reference to the accompanying drawings. An embodiment and the terms used herein are not intended to limit the technology mentioned in the present document to a specific embodiment and should be construed as including various changes of the corresponding embodiment, equivalents thereof, and/or alternatives thereof. In the drawings, like reference symbols may denote like constituent elements. The expression of a singular form may include the expression of a plural form unless otherwise dictating clearly in context. In the present document, the expressions "A or B", "at least one of A and/or B", etc. may include all available combinations of words enumerated together. The expressions "1st", "2nd", "first", "second", etc. may modify corresponding constituent elements irrespective of order and/or importance, and are just used to distinguish one constituent element from another constituent element and do not limit the corresponding constituent elements. When it is mentioned that any (e.g., 1st) constituent element is "(operatively or communicatively) coupled with/to" or is "connected to" another (e.g., 2nd) constituent element, the constituent element may be directly coupled to another constituent element, or be coupled through a further constituent element (e.g., a third constituent element).

The expression "configured (or set) to" used in the present document may be used interchangeably with, for example, "suitable for", "having the capacity to", "designed to", "adapted to", "made to", or "capable of" in a hardware or software manner in accordance to circumstances. In any situation, the expression "device configured to" may represent that the device is "capable of" a specific operation in conjunction with other devices or components. For example, the phrase "processor configured (or set) to perform A, B and C" may represent an exclusive processor (e.g., embedded processor) for performing a corresponding operation, or a generic-purpose processor (e.g., a central processing unit (CPU) or an application processor (AP)) capable of performing corresponding operations by executing one or more software programs stored in a memory device.

An electronic device according to various embodiments of the present document may, for example, include at least one of a smartphone, a tablet personal computer (PC), a mobile phone, a video phone, an electronic book reader, a desktop PC, a laptop PC, a netbook computer, a workstation, a server, a portable digital assistant (PDA), a portable multimedia player (PMP), an MPEG-1 audio layer-3 (MP3) player, a medical device, a camera or a wearable device. The wearable device may include at least one of an accessory type (e.g., a watch, a ring, a wristlet, an anklet, a necklace, glasses, a contact lens or a head-mounted-device (HMD)), a fabric or clothing integrated type (e.g., electronic clothes), a human-body mount type (e.g., a skin pad or tattoo) or a bio implantation type (e.g., an implantable circuit). According to certain embodiment, the electronic device may, for example, include at least one of a television (TV), a digital versatile disc (DVD) player, an audio system, a refrigerator, an air conditioner, a cleaner, an oven, a microwave, a washing machine, an air cleaner, a set-top box, a home automation control panel, a security control panel, a media box (for example, Samsung HomeSync™, Apple TV™ or Google TV™), a game console (e.g., Xbox™ or PlayStation™), an electronic dictionary, an electronic locking system, a camcorder or an electronic frame.

In another embodiment, the electronic device may include at least one of various medical devices (e.g., various portable medical measurement devices (e.g., a blood glucose sensor, a heat rate sensor, a blood pressure monitor, a body temperature meter, etc.), magnetic resonance angiography (MRA), magnetic resonance imaging (MM), computed tomography (CT), a imaging equipment, an ultrasonic instrument, etc.)), a navigation device, a global navigation satellite system (GNSS), an event data recorder (EDR), a flight data recorder (FDR), a car infotainment device, an electronic equipment for ship (e.g., a vessel navigation device, a gyro compass, etc.), avionics, a security device, a car head unit, an industrial or domestic robot, a drone, an automatic teller's machine (ATM) of a financial institution, point of sales (POS) of shops, an internet of things (IoT) device (e.g., an electric bulb, various sensors, a sprinkler device, a fire alarm, a thermostat, a streetlight, a toaster, an exerciser, a hot water tank, a heater, a boiler, etc.). According to certain embodiment, the electronic device may include at least one of a part of furniture, a building/structure or a car, an electronic board, an electronic signature receiving device, a projector or various metering devices (e.g., tap water, electricity, gas, radio wave metering devices or the like). In various embodiments, the electronic device may be flexible, or be a combination of two or more of the aforementioned various devices. The electronic device according to an embodiment of the present document is not limited to the aforementioned devices. In the present document, the term 'user' may denote a person who uses the electronic device or a device (e.g., an artificial-intelligent electronic device) which uses the electronic device.

FIG. 1 illustrates, in block diagram format an electronic device in a network environment system according to certain embodiments of the present disclosure.

Referring to FIG. 1, an electronic device 100 within a network environment 10 according to various embodiments is described. The electronic device 100 may include a bus 110, a processor 120, a memory 130, an input output interface 150, a display 160, and a communication interface 170. In some embodiments, the electronic device 100 may omit at least one of the constituent elements or additionally have another constituent element. The bus 110 may, for example, include a circuit coupling the constituent elements 110, 120, 150, 160 and 170 to one another and forwarding communication (e.g., a control message or data) between the constituent elements. The processor 120 may include one or more of a central processing unit (CPU), an application processor (AP) or a communication processor (CP). The processor 120 may, for example, execute operation or data processing for control and/or communication of at least one another constituent element of the electronic device 100.

The memory 130 may include a volatile and/or non-volatile memory. The memory 130 may, for example, store a command or data related to at least one another constituent element of the electronic device 100. According to an embodiment, the memory 130 may store a software and/or program 140. The program 140 may, for example, include a kernel 141, a middleware 143, an application programming interface (API) 145, an application program (or "application") 147, and the like. At least some of the kernel 141, the middleware 143 or the API 145 may be called an operating system (OS). The kernel 141 may, for example, control or manage system resources (e.g., bus 110, processor 120, memory 130, and the like) that are used for executing operations or functions implemented in other programs (e.g., middleware 143, API 145 or application program 147). Also, the kernel 141 may provide an interface through which the middleware 143, the API 145 or the application program 147 may control or manage the system resources of the electronic device 100 by accessing the individual constituent element of the electronic device 100.

Middleware 143 may, for example, perform a relay role of enabling the API 145 or the application program 147 to communicate and exchange data with the kernel 141. Also, according to certain embodiments, middleware 143 may process one or more work requests that are received from the application program 147, in accordance with priority. For example, the middleware 143 may grant priority capable of using the system resources (e.g., the bus 110, the processor 120, the memory 130 or the like) of the electronic device 100 to at least one of the application programs 147, and process one or more work requests. The API 145 can, for example, be an interface enabling the application program 147 to control a function provided by the kernel 141 or the middleware 143 and may, for example, include at least one interface or function (e.g., an instruction) for file control, window control, image processing, character control or the like. The input output interface 150 may forward a command or data inputted from a user or another external device, to another constituent element(s) of the electronic device 100, or output a command or data received from the another constituent element(s) of the electronic device 100, to the user or another external device.

The display 160 may, for example, include a liquid crystal display (LCD), a light emitting diode (LED) display, an organic light emitting diode (OLED) display, a microelectromechanical systems (MEMS) display or an electronic paper display. The display 160 may, for example, display various contents (e.g., a text, an image, a video, an icon, a symbol and/or the like) to a user. The display 160 may include a touch screen. And, for example, the display 160 may receive a touch, gesture, proximity or hovering input that uses an electronic pen or a part of the user's body.

The communication interface 170 may, for example, establish communication between the electronic device 100 and an external device (e.g., the first electronic device 102, the second electronic device 104 or the server 106). For example, the communication interface 170 may be coupled to a network 162 through wireless communication or wired communication, to communicate with the external device (e.g., the second electronic device 104 or the server 106).

The wireless communication may, for example, include a cellular communication that uses at least one of long term evolution (LTE), LTE-advanced (LTE-A), code division multiple access (CDMA), wideband CDMA (WCDMA), universal mobile telecommunications system (UMTS), wireless broadband (WiBro), global system for mobile communications (GSM) and the like. According to an embodiment, the wireless communication may, for example, include at least one of wireless fidelity (WiFi), Bluetooth (BT), Bluetooth low energy (BLE), Zigbee, near field communication (NFC), magnetic secure transmission (MST), radio frequency (RF) or body area network (BAN). According to an embodiment, the wireless communication may include GNSS. The GNSS may, for example, be a global positioning system (GPS), a global navigation satellite system (Glonass), Beidou navigation satellite system (hereinafter, "Beidou")) or Galileo, the European global satellite-based navigation system. Hereinafter, the "GPS" may be used interchangeably with the "GNSS". The wired communication may, for example, include at least one of a universal serial bus (USB), a high definition multimedia interface (HDMI), a recommended standard-232 (RS-232), power line communication (PLC), a plain old telephone service (POTS), and the like. The network 162 may include at least one of a telecommunications network, for example, a computer network (e.g., local area network (LAN) or wide area network (WAN)), the Internet or a telephone network.

Each of the first and second electronic devices 102 and 104 may be a device of the same or different type from that of the electronic device 100. According to various embodiments, all or some of operations executed in the electronic device 100 may be executed in another one electronic device or a plurality of electronic devices (e.g., the electronic devices 102 and 104 or the server 106). According to certain embodiments, where the electronic device 100 performs some function or service automatically or in response to a request, the electronic device 100 may, instead of or additionally to executing the function or service in itself, send a request for execution of at least a partial function associated with this to another device (e.g., electronic device 102, 104 or server 106). Another electronic device (e.g., electronic device 102, 104 or server 106) may execute the requested function or additional function, and forward the execution result to the electronic device 100. The electronic device 100 may process the received result as it is or additionally, to provide the requested function or service. For this, a cloud computing, distributed computing or client-server computing technology may be used, for example.

Figure 2:
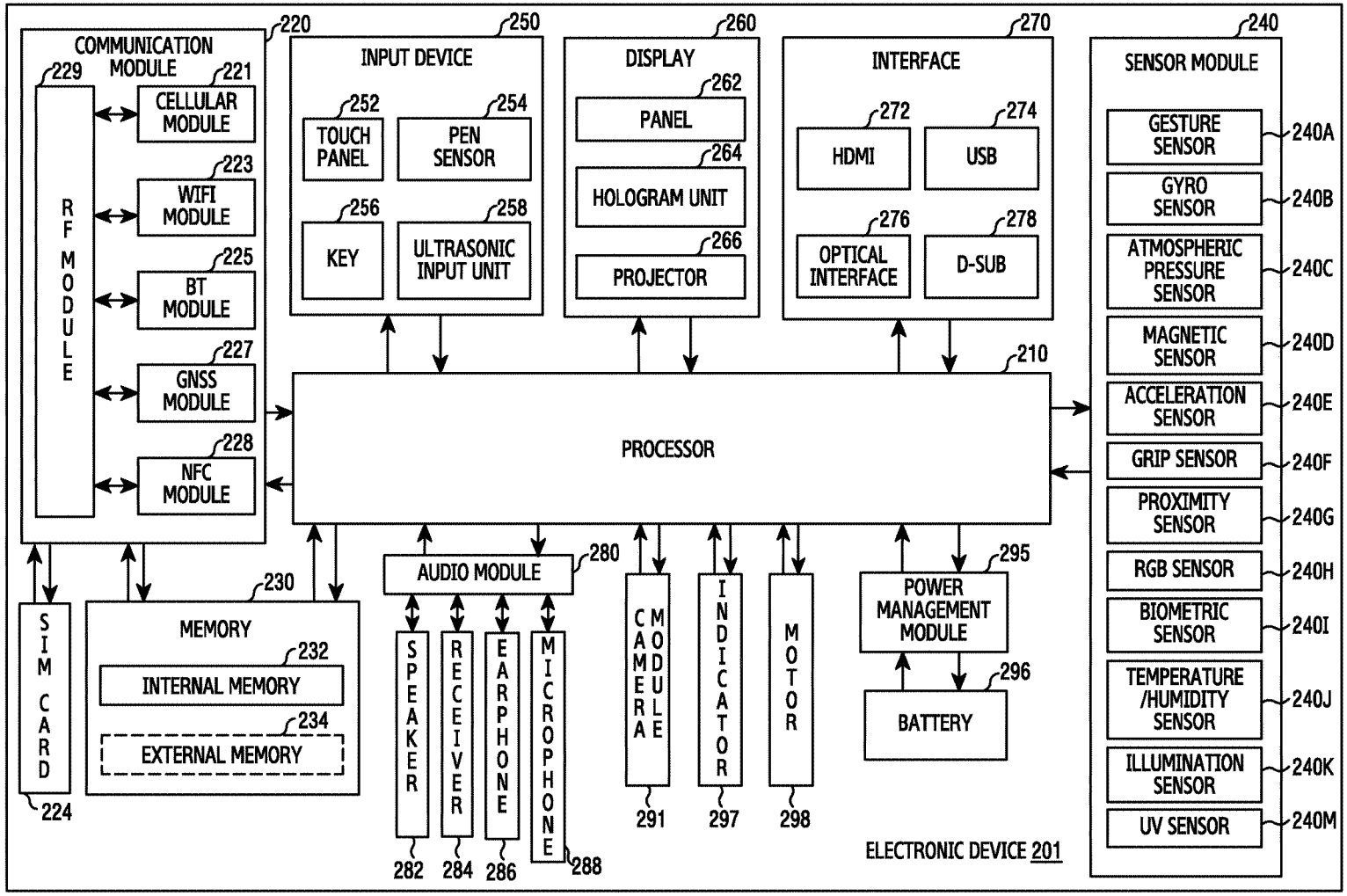
FIG. 2 illustrates, in block diagram form, an electronic device according to various exemplary embodiments of the present disclosure.

FIG. 2 illustrates, in block diagram format, an electronic device according to various embodiments of the present disclosure.

Referring to FIG. 2, an electronic device 201 may, for example, include the entirety or part of the electronic device 100 illustrated in FIG. 1. The electronic device 201 may, according to certain embodiments, include one or more processors (e.g., application processors (APs)) 210, a communication module 220, a subscriber identification module 224, a memory 230, a sensor module 240, an input device 250, a display 260, an interface 270, an audio module 280, a camera module 291, a power management module 295, a battery 296, an indicator 297 and a motor 298.

The processor 210 may, according to some embodiments, power an operating system or an application program to control a majority of hardware or software constituent elements coupled to the processor 210, and may perform various data processing and operations. The processor 210 may be, for example, implemented as a system on chip (SoC). According to various embodiments, the processor 210 may further include a graphic processing unit (GPU) and/or an image signal processor (ISP). The processor 210 may include at least some (e.g., cellular module 221) of the constituent elements illustrated in FIG. 2 as well. The processor 210 may load a command or data received from at least one of the other constituent elements (e.g., non-volatile memory), to a volatile memory, to process the loaded command or data, and store the result data in the non-volatile memory.

According to certain embodiments of the present disclosure, communication module 220 may, for example, have the same or similar construction with the communication interface 170. The communication module 220 may, for example, include a cellular module 221, a WiFi module 223, a Bluetooth module 225, a GNSS module 227, a near field communication (NFC) module 228, and a radio frequency (RF) module 229. The cellular module 221 may, for example, provide voice telephony, video telephony, a text service, an Internet service or the like through a telecommunication network. According to at least one embodiment, the cellular module 221 may perform the distinction and authentication of the electronic device 201 within the telecommunication network, by using the subscriber identification module (e.g., SIM card) 224. According to various embodiments, the cellular module 221 may perform at least some functions among functions that the processor 210 may provide. According to certain embodiments, cellular module 221 may include a communication processor (CP). According to some embodiment, at least some (e.g., two or more) of the cellular module 221, the WiFi module 223, the Bluetooth module 225, the GNSS module 227 or the NFC module 228 may be included within one integrated chip (IC) or IC package. The RF module 229 may, for example, transmit and receive a communication signal (e.g., RF signal). The RF module 229 may, for example, include a transceiver, a power amplifier module (PAM), a frequency filter, a low noise amplifier (LNA), an antenna or the like. According to another embodiment, at least one of the cellular module 221, the Wi-Fi module 223, the Bluetooth module 225, the GNSS module 227 or the NFC module 228 may transmit and receive a RF signal through a separate RF module. The subscriber identification module 224 may, for example, include a card including a subscriber identification module and/or an embedded SIM. And, the subscriber identification module 224 may include unique identification information (e.g., integrated circuit card identifier (ICCID)) or subscriber information (e.g., international mobile subscriber identity (IMSI)).

The memory 230 (e.g., memory 130) may, for example, include an internal memory 232 or an external memory 234. The internal memory 232 may, for example, include at least one of a volatile memory (e.g., a dynamic random access memory (DRAM), a static RAM (SRAM), a synchronous dynamic RAM (SDRAM) or the like) and a non-volatile memory (e.g., one time programmable read only memory (OTPROM), a programmable ROM (PROM), an erasable PROM (EPROM), an electrically EPROM (EEPROM), a mask ROM, a flash ROM, a flash memory, a hard drive or a solid state drive (SSD)). The external memory 234 may include a flash drive, for example, a compact flash (CF), a secure digital (SD), a micro-SD, a mini-SD, an extreme Digital (xD), a Multi Media Card (MMC), a memory stick or the like. The external memory 234 may be operatively or physically coupled with the electronic device 201 through various interfaces.

According to various embodiments of the present disclosure, sensor module 240 may, for example, measure a physical quantity or sense an activation state of the electronic device 201, to convert measured or sensed information into an electrical signal. The sensor module 240 may, for example, include at least one of a gesture sensor 240A, a gyro sensor 240B, a barometer 240C, a magnetic sensor 240D, an acceleration sensor 240E, a grip sensor 240F, a proximity sensor 240G, a color sensor 240H (e.g., a red, green, blue (RGB) sensor), a medical sensor 240I, a temperature/humidity sensor 240J, an illuminance sensor 240K or an ultra violet (UV) sensor 240M. Additionally or alternatively, the sensor module 240 may, for example, include an E-nose sensor, an electromyography (EMG) sensor, an electroencephalogram (EEG) sensor, an electrocardiogram (ECG) sensor, an infrared (IR) sensor, an iris scan sensor and/or a finger scan sensor. The sensor module 240 may further include a control circuit for controlling at least one or more sensors belonging therein. In some embodiment, the electronic device 201 may further include a processor configured to control the sensor module 240 as a part of the processor 210 or separately, thereby controlling the sensor module 240 while the processor 210 is in a sleep state.

According to certain embodiments of the present disclosure, input device 250 may, for example, include a touch panel 252, a (digital) pen sensor 254, a key 256 or an ultrasonic input device 258. The touch panel 252 may, for example, use at least one scheme among a capacitive overlay scheme, a pressure sensitive scheme, an infrared beam scheme or an ultrasonic scheme. Also, the touch panel 252 may further include a control circuit. In some embodiments, touch panel 252 may further include a tactile layer to provide a tactile response to a user. The (digital) pen sensor 254 may, for example, be a part of the touch panel 252, or include a separate sheet for recognition. The key 256 may, for example, include a physical button, an optical key or a keypad. The ultrasonic input device 258 may sense an ultrasonic wave generated in an input tool, through a microphone (e.g., microphone 288), to confirm data corresponding to the sensed ultrasonic wave.

According to certain embodiments of the present disclosure, display 260 (e.g., the display 160) may include a panel 262, a hologram device 264, a projector 266, and/or a control circuit for controlling them. The panel 262 may, for example, be implemented to be flexible, transparent, or wearable. The panel 262 may be constructed as one or more modules together with the touch panel 252. The hologram device 264 may show a three-dimensional image to the air using an interference of light. Alternatively or additionally, projector 266 may project light onto a screen to display an image. The screen may, for example, be located inside or outside the electronic device 201. The interface 270 may, for example, include an HDMI 272, a USB 274, an optical interface 276 or a D-subminiature (D-sub) interface 278. The interface 270 may, for example, be included in the communication interface 170 illustrated in FIG. 1. Additionally or alternatively, the interface 270 may, for example, include a Mobile High-definition Link (MHL) interface, an SD card/Multi Media Card (MMC) interface or an Infrared Data Association (IrDA) standard interface.

According to various embodiments of the present disclosure, audio module 280 may, for example, convert a sound and an electrical signal interactively. At least some constituent elements of the audio module 280 may be, for example, included in the input output interface 150 illustrated in FIG. 1. The audio module 280 may for example, process sound information that is inputted or outputted through a speaker 282, a receiver 284, and an earphone 286, the microphone 288 or the like. The camera module 291 is, for example, a device able to photograph a still image and a video. According to an embodiment, the camera module 291 may include one or more image sensors (e.g., front sensor or rear sensor), a lens, an image signal processor (ISP) or a flash (e.g., an LED, a xenon lamp or the like). The power management module 295 may, for example, manage the electric power of the electronic device 201. According to an embodiment, the power management module 295 may include a power management integrated circuit (PMIC), a charger IC or a battery or fuel gauge. The PMIC may, for example, employ a wired and/or wireless charging scheme. The wireless charging scheme may, for example, include a magnetic resonance scheme, a magnetic induction scheme, an electromagnetic wave scheme or the like. And, the wireless charging scheme may further include a supplementary circuit for wireless charging, for example, a coil loop, a resonance circuit, a rectifier or the like. The battery gauge may, for example, measure a level of the battery 296, a voltage being in charge, an electric current or a temperature. The battery 296 may, for example, include a rechargeable battery and/or a solar battery.

The indicator 297 may display a specific state, for example, a booting state, a message state, a charging state or the like of the electronic device 201 or a part (e.g., processor 210) of the electronic device 201. The motor 298 may convert an electrical signal into a mechanical vibration, and may generate a vibration, a haptic effect or the like. The electronic device 201 may, for example, include a mobile TV support device (e.g., GPU) capable of processing media data according to the standards of digital multimedia broadcasting (DMB), digital video broadcasting (DVB), mediaFlo™ or the like. According to various embodiments of the present disclosure, each of the constituent elements described above may consist of one or more components, and a name of the corresponding constituent element may be varied according to the kind of the electronic device. In various embodiments, the electronic device (e.g., electronic device 201) may omit some constituent elements, or further include additional constituent elements, or combine some of the constituent elements to configure one entity, but identically perform functions of corresponding constituent elements before combination.

Figure 3:
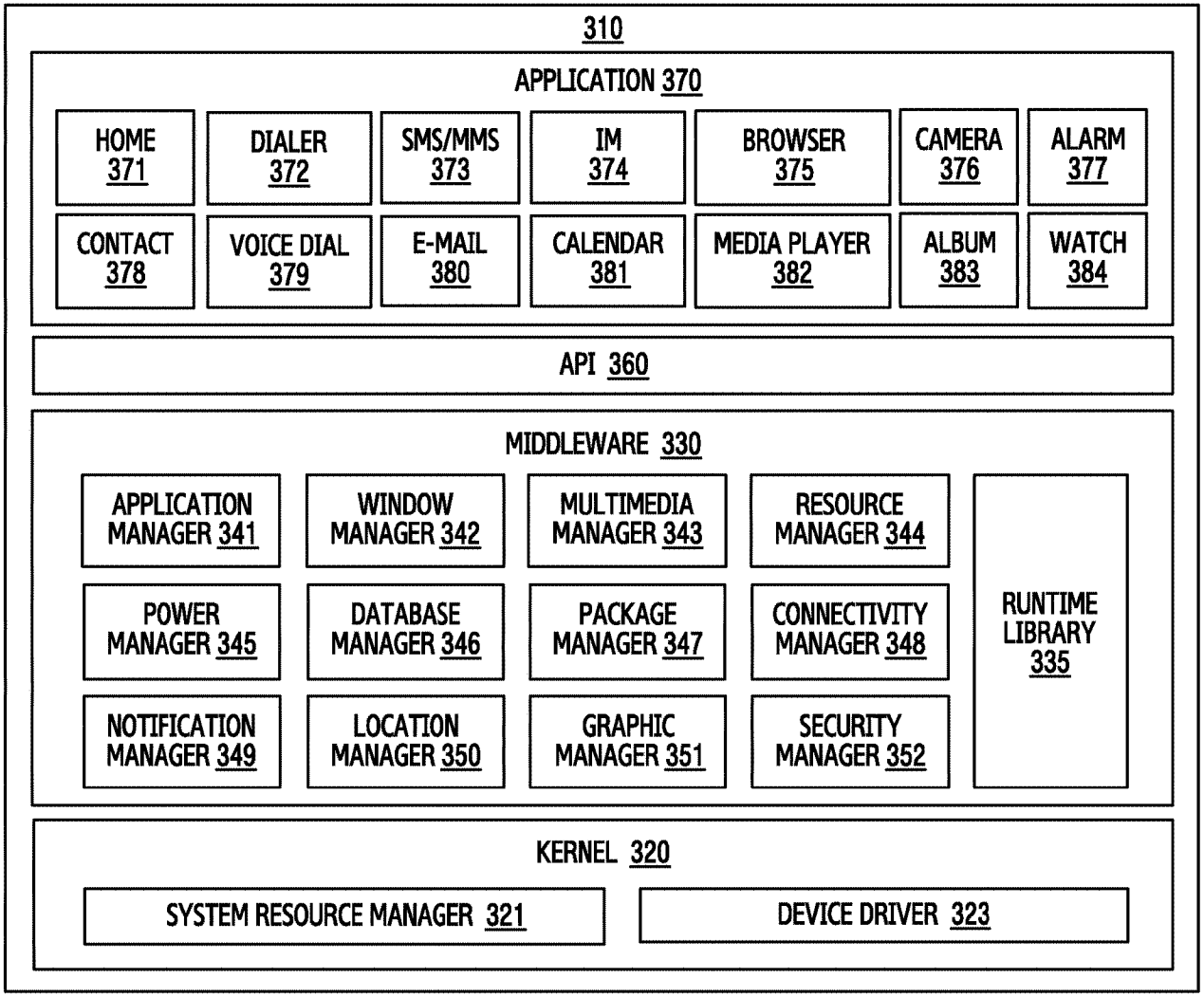
FIG. 3 illustrates, in block diagram form, a program module according to various exemplary embodiments of the present disclosure.

FIG. 3 illustrates, in block diagram format, a program module according to various embodiments of the present disclosure.

Referring to FIG. 3, a program module 310 (e.g., the program 140) may include an Operating System (OS) for controlling resources related to an electronic device (e.g., the electronic device 100) and/or various applications (e.g., the application program 147) driven on the operating system. The operating system may, for example, include Android™, iOS™, Windows™, Symbian™, Tizen™ or Bada™. Referring to FIG. 3, the program module 310 may include a kernel 320 (e.g., the kernel 141), a middleware 330 (e.g., the middleware 143), an API 360 (e.g., the API 145), and/or an application 370 (e.g., the application program 147). At least a part of the program module 310 may be preloaded onto an electronic device, or be downloaded from an external electronic device (e.g., the electronic device 102, 104, the server 106, etc.).

The kernel 320 may, for example, include a system resource manager 321 and/or a device driver 323. The system resource manager 321 may perform control of a system resource, allocation thereof, recovery thereof or the like. According to an embodiment, the system resource manager 321 may include a process management unit, a memory management unit or a file system management unit. The device driver 323 may, for example, include a display driver, a camera driver, a Bluetooth driver, a shared memory driver, a USB driver, a keypad driver, a WiFi driver, an audio driver or an inter-process communication (IPC) driver. The middleware 330 may, for example, provide a function that the application 370 needs, or provide various functions to the application 370 through the API 360 so that the application 370 may use restricted system resources within an electronic device. According to an embodiment, the middleware 330 may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351 or a security manager 352.

According to certain embodiments of the present disclosure, runtime library 335 may, for example, include a library module that a compiler uses to add a new function through a programming language while the application 370 is executed. The runtime library 335 may perform input output management, memory management or arithmetic function processing. The application manager 341 may, for example, manage a lifecycle of the application 370. The window manager 342 may manage a graphic user interface (GUI) resource used by a screen. The multimedia manager 343 may detect a format required for playing media files, and perform encoding or decoding of the media file by using a codec suitable to the corresponding format. The resource manager 344 may manage a source code of the application 370 or a space of a memory. The power manager 345 may, for example, manage a battery capacity or a power supply, and provide power information required for an operation of an electronic device. According to an embodiment, the power manager 345 may interwork with a basic input/output system (BIOS). The database manager 346 may, for example, create, search or change a database that will be used by the application 370. The package manager 347 may manage installation or updating of an application that is distributed in a form of a package file.

The connectivity manager 348 may, for example, manage wireless connectivity. The notification manager 349 may, for example, provide events such as an arrival message, an appointment, a proximity notification, etc. to a user. The location manager 350 may, for example, manage location information of an electronic device. The graphic manager 351 may, for example, manage a graphic effect that will be provided to a user, or a user interface related with this. The security manager 352 may, for example, provide system security or user authentication. According to an embodiment, the middleware 330 may include a telephony manager for managing a voice or video telephony function of an electronic device, or a middleware module capable of forming a combination of functions of the aforementioned constituent elements. According to an embodiment, the middleware 330 may provide a module that is specialized based on the type of an operating system. The middleware 330 may dynamically delete some of the existing constituent elements or add new constituent elements. The API 360 is, for example, a set of API programming functions, and may be provided to have another construction in accordance with the operating system. For example, Android or iOS may provide one API set by platform, and Tizen may provide two or more API sets by platform.

According to certain embodiments of this disclosure, application 370 may, for example, include a home 371, a dialer 372, a short message service (SMS)/multimedia messaging service (MMS) 373, an instant message (IM) service 374, a browser 375, a camera 376, an alarm 377, a contact 378, a voice dial 379, an electronic mail (e-mail) service 380, a calendar 381, a media player 382, an album 383, a watch 384, health care (e.g., measuring a momentum, a blood sugar or the like), or an environment information (e.g., air pressure, humidity or temperature information) provision application. According to an embodiment, the application 370 may include an information exchange application that may support information exchange between an electronic device and an external electronic device. The information exchange application may, for example, include a notification relay application for relaying specific information to the external electronic device, or a device management application for managing the external electronic device. For example, the notification relay application may relay notification information generated by another application of an electronic device to an external electronic device, or receive notification information from the external electronic device to provide the received notification information to a user. The device management application may, for example, install, delete or update a function (e.g., turn-on/turn-off of the external electronic device itself (or some constituent components) or adjustment of a brightness (or resolution) of a display) of the external electronic device that communicates with the electronic device, or an application operating in the external electronic device. According to an embodiment, the application 370 may include an application (e.g., a health care application of a mobile medical instrument) designated according to an attribute of the external electronic device. According to at least one embodiment, application 370 may include an application received from the external electronic device. According to some embodiments, at least a part of program module 310 may be implemented (e.g., executed) by software, firmware, hardware (e.g., the processor 210) or a combination of at least two or more of them, and may include a module for performing one or more functions, a program, a routine, sets of instructions or a process.

Figure 4:
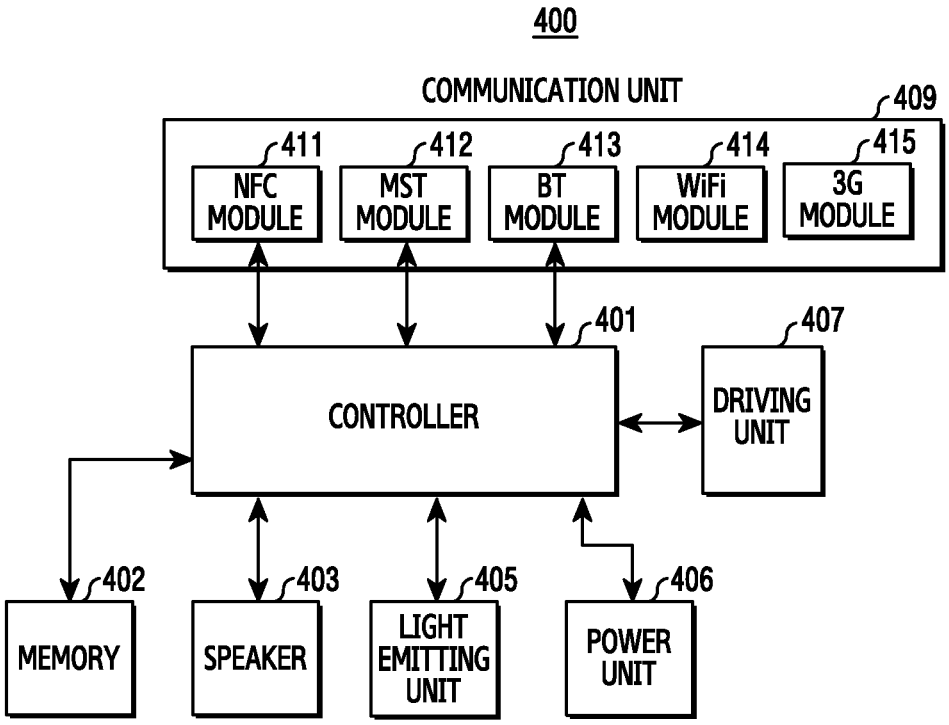
FIG. 4 illustrates, in block diagram form, a door lock capable of being unlocked using an electronic device according to various exemplary embodiments of the present disclosure.

FIG. 4 illustrates, in block diagram format, a door lock capable of being unlocked using an electronic device according to various exemplary embodiments of the present disclosure.

Referring to FIG. 4, the door lock 400 may, according to certain embodiments of the present disclosure, include a controller 401, a communication unit 409, a driving unit 407, a speaker 403, a light emitting unit (e.g., a LED) 405 and a power unit 406.

The communication unit 409 may include a NFC module 411, a MST module 412, a Bluetooth module 413, a WiFi module 414, and a 3G module 415.

According to some embodiments, door lock 400 may receive a key for unlock from an electronic device (e.g., the electronic device 100) via the communication unit 409. The door lock 400 may receive the key from the electronic device by using a short-range communication module (for instance, the NFC module 411, the MST module 412 and/or the Bluetooth module 413). The key may be encrypted and transmitted from the electronic device.

In certain embodiments of this disclosure, the door lock 400 may receive a key from a server (For example, server 300 of FIG. 5) via a mobile communication network by using the 3G module 415 as well.

According to certain embodiments of the present disclosure, door lock 400 has a unique credential capable of unlocking the door lock 400. The credential may be given by a manufacturer at the time of manufacture. Also, in the case of a door lock having a communication function, this credential may be given via a server as well. The door lock 400 may be not only attached to a gate located in a home, a building and an office, but also may be attached to a moving structure such as a car door or trunk.

According to certain embodiments of the present disclosure, the term key may be interpreted as referring to an authentication means which includes not only a function of unlocking a door lock but also a role of a key for starting up a car, a virtual key for operating an electronic device and a virtual key for financial transaction.

According to some embodiments of this disclosure, driving unit 407 may drive a locking device by the rotation of a motor or an electromagnet, to operate a door lock in an unlocking or locking state.

When the door lock 400 is unlocked normally, the speaker 403 outputs a predetermined sound under the control of the controller 401.

When the door lock 400 is unlocked normally, the light emitting unit (for instance, a LED) 405 may emit light in a predetermined pattern or predetermined color under the control of the controller 401.

The power unit 406 (for instance, a battery) supplies power to the door lock 400.

According to certain embodiments of the present disclosure, memory 402 may store credential data used for unlocking the door lock 400. The credential data may, depending on the embodiment, be generated by a manufacturer at the time of door lock manufacturing, and stored in the memory 402 of the door lock 400. For convenience of description and clarity of nomenclature in explaining the nonlimiting example of FIG. 4 and embodiments according to the present disclosure, credential data stored in the memory 402 of the door lock 400 is called first credential data, and credential data transmitted from an electronic device is called second credential data.

The controller 401 may control the communication unit 409, the driving unit 407, the memory 402, the speaker 403 and the light emitting unit 405, to control or present the door lock 400 in an unlocking or locking state.

For example, if a key is transmitted from the electronic device, the door lock 400 may receive the key via the communication unit, and extract the second credential data from the received key, and compare the extracted second credential data with the first credential data stored in the memory 402 of the door lock 400. When the first credential data and the second credential data match with each other as the comparison result, the controller 401 may control the driving unit 407 to unlock a locking device of the door lock 400.

When the door lock 400 is unlocked normally, the controller 401 may control the speaker 403 to output a designated sound.

Or, when the door lock 400 is unlocked normally, the controller 401 may control the light emitting unit 405 to emit light in a designated pattern or a predetermined color.

Or, when the door lock 400 is unlocked normally, the controller 401 may control the Bluetooth module 413 to transmit data corresponding to a success of unlocking, to the electronic device.

According to certain embodiments of the present disclosure, door lock 400 may omit some constituent elements, or further include additional constituent elements, or combine and configure some of the constituent elements as one entity but identically perform functions of the corresponding constituent elements before combination.

Figure 5:
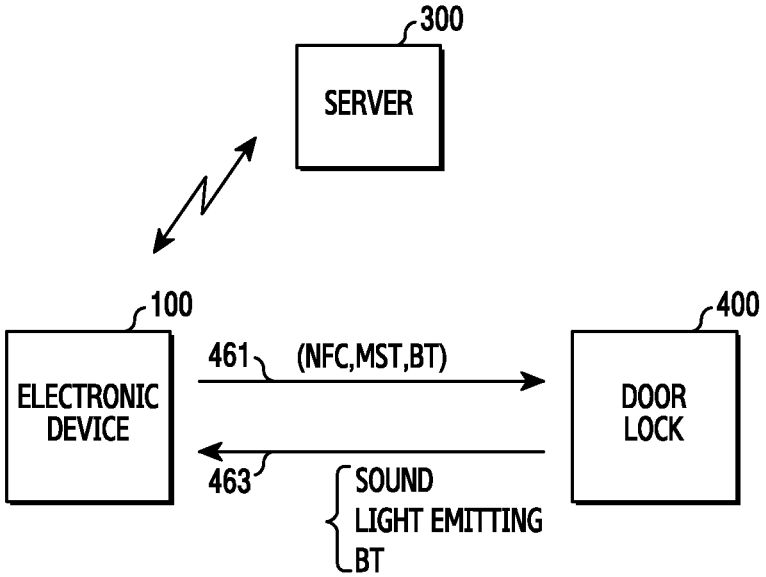
FIG. 5 illustrates operations among an electronic device, a door lock and a server according to various exemplary embodiments of the present disclosure.

FIG. 5 illustrates operations among an electronic device, a door lock and a server according to various exemplary embodiments of the present disclosure.

Referring to FIG. 5, the electronic device 100, the server 300 and the door lock 400 are illustrated.

According to certain embodiments, electronic device 100 may receive a key from the server 300. For example, the electronic device 100 may receive the key from the server 300 through a smart key App provided by a manufacturer of the door lock 400. If a user installs and runs the smart key App in the electronic device 100 and then requests a key of the door lock 400, the server 300 may authenticate the user and then, transmit the key to the electronic device 100.

The key may include credential data capable of unlocking a locking device of the door lock 400. In addition, the key may include various fields. A structure of the key will be described later.

According to certain embodiments, electronic device 100 may transmit, to the door lock 400, the key received from the server 300, via a short-range communication protocol 461 (i.e., NFC, MST, and/or Bluetooth). The door lock 400 may extract credential data (e.g., second credential data) from among the key received from the electronic device 100, and compare the extracted credential data with credential data (e.g., first credential data) stored in the memory 402 of the door lock 400, and unlock the locking device of the door lock 400.

After unlocking the locking device of the door lock 400, the door lock 400 may output a predetermined sound and/or light.

According to certain embodiments of the present disclosure, when the door lock 400 includes a Bluetooth module, after unlocking the locking device, the door lock 400 may transmit a signal 463 representing that the locking device has been unlocked, to the electronic device 100 via the Bluetooth module.

According some embodiments of this disclosure, the electronic device 100 may transmit only the credential data (e.g., the second credential data) to the door lock 400 as well.

For the purposes of the present disclosure, the phrase "transmitting a key" may be understood to also refer to "transmitting credential data."

Figure 6:
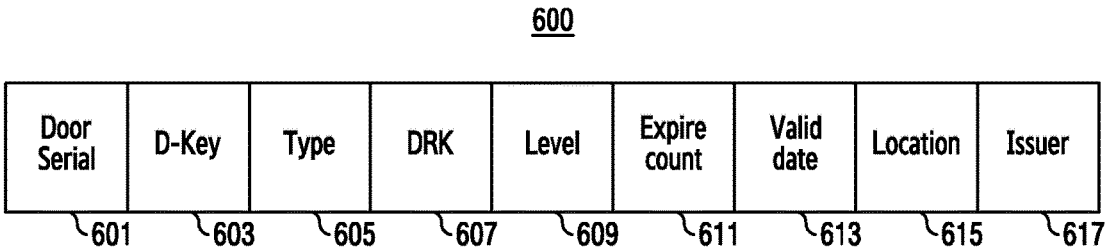
FIG. 6 illustrates a structure of a key stored in a memory of an electronic device according to various exemplary embodiments of the present disclosure.

FIG. 6 illustrates structural aspects of a key stored in a memory of an electronic device according to various embodiments of the present disclosure.

Referring to FIG. 6, the key 600 may, according to various embodiments of the present disclosure, include a plurality of data fields 601 to 617.

According to some embodiments, field 601 may comprise a serial number of a door. The serial number may be designated by a user or be provided by a manufacturer of a door lock.

According to certain embodiments, field 603 may include credential data capable of unlocking the door lock. That is, the field 603 may be a unique number for unlocking a locking state of the door lock.

Field 605 may indicate the type of the key 600. The type may be data for distinguishing whether a door is in a fixed location like a main gate or whether it is a mobile type like a car door or trunk. Also, the type may be data indicating a key for operating a specific device like starting up a car.

The electronic device 100 may determine whether to transmit a plurality of keys to the door lock 400 sequentially based on the field 605 as well. For example, when a value of field 605 (i.e., the type) corresponds to '1', the electronic device 100 may determine that the key is a key used for an apartment joint main gate. In this case, the electronic device 100 may extract a plurality of keys among a plurality of keys stored in a memory (e.g., the memory 130) based on location information of the electronic device 100, and transmit the extracted plurality of keys to the apartment joint main gate sequentially.

When a value of field 605 (i.e., the type) corresponds to '2', the electronic device 100 may determine that the key is a key used for a home gate of a home. In this case, to prevent key hooking, the electronic device 100 may not transmit a plurality of keys to the home gate sequentially.

Also, the electronic device 100 may, according to certain embodiments, determine whether to link with location information of the electronic device 100 based on the field 605. For example, when a value of field 605 (i.e., the type) corresponds to '3', the electronic device 100 may extract a plurality of keys from the memory 130 of the electronic device 100 based on the location information of the electronic device 100, and transmit the extracted plurality of keys to the door lock 400 sequentially. When the value of field 605 (i.e., the type) corresponds to '4', the electronic device 100 may not use the location information of the electronic device 100.

According to certain embodiments, field 607 may be a delivery route key (DRK) for encrypting communication between the electronic device 100 and the server 300.

In some embodiments according to the present disclosure, field 609 may be data indicating an authority level of the key. For example, in case where a user may open a door and a trunk and start an engine with one key as in a car, the user may open only the car trunk when a value of the field 609 is '1', and the user may open the door and the trunk when the value of the field 609 is '2', and the user may open the door and the trunk and even start the engine when the value of the field 609 is '3'.

According to some embodiments of the present disclosure, field 611 may comprise data indicating a count capable of using the key. For example, when a value of the field 611 indicates or includes '5', the electronic device 100 may use the key up to 5 times.

According to some embodiments, field 613 may include data indicating a valid period capable of using the key. The field 613 may be a date or period (time).

For example, when a value of the field 613 indicates or includes '20161231', the electronic device 100 may use the key until Dec. 31, 2016 and after that time, may not use the key. Or, when the value of the field 613 indicates '24 hours', the electronic device 100 may use the key only by 24 hours after getting the issuance of the key.

According to certain embodiments of this disclosure, field 615 may include location information indicating a location capable of using the key. The electronic device 100 may transmit or not transmit the key to the door lock 400 based on the location information of the field 615.

For example, when the location information of the field 615 indicates a location A, in the location A, the electronic device 100 may unlock the door lock 400, but in a location B different from the location A, the electronic device 100 may not unlock the door lock 400 by using the key.

According to some embodiments of this disclosure, field 617 may include information of an issuer who has issued the key. For example, the field 617 may include information of a manufacturer which has manufactured the door lock 400.

In various exemplary embodiments, the fields included in the key 600 may omit constituent elements or further include additional constituent elements, or combine and configure some of the constituent elements as one entry.

Figure 7:
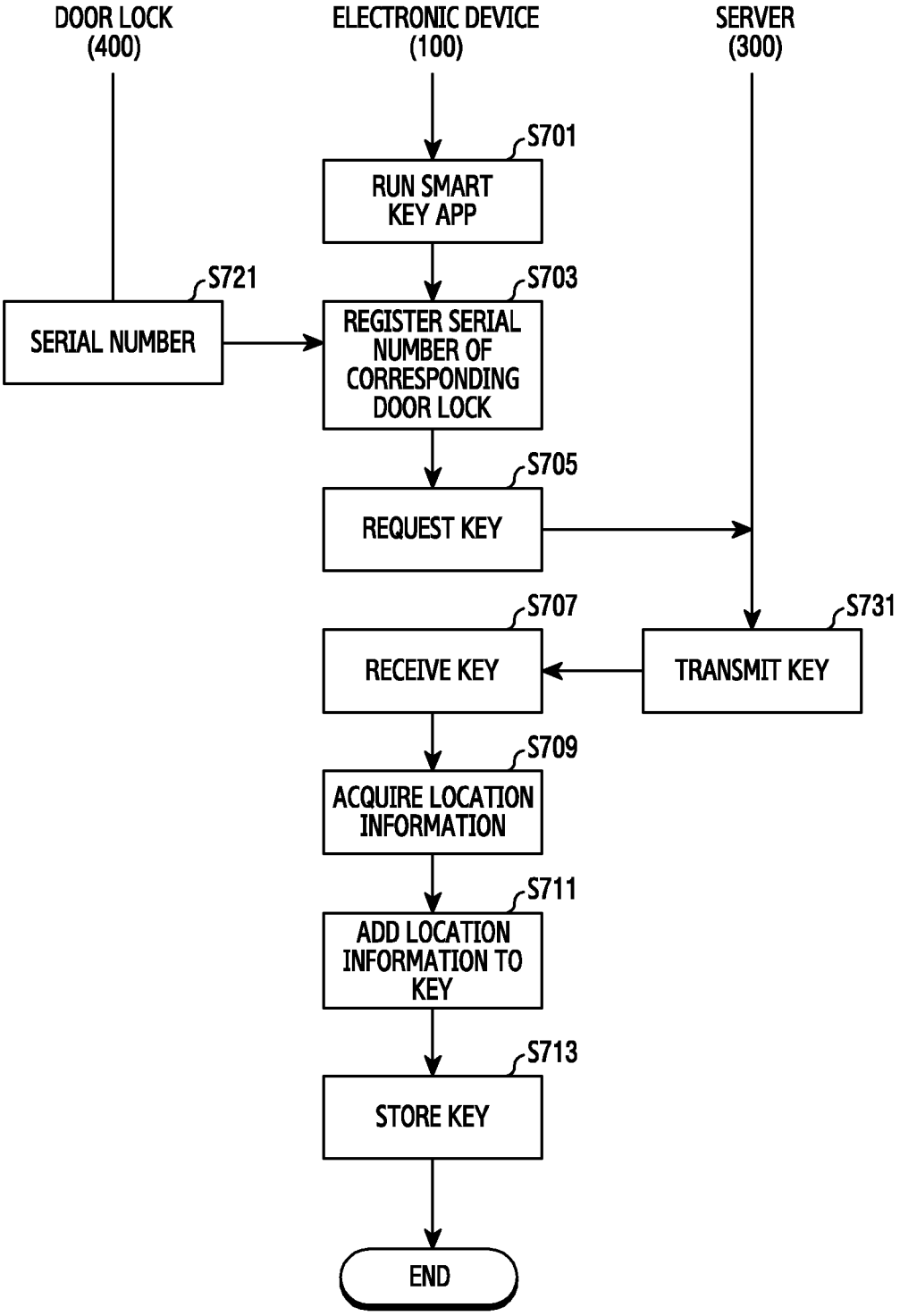
FIG. 7 illustrates operations of a process by which an electronic device is issued a key from a server according to various exemplary embodiments of the present disclosure.

FIG. 7 illustrates operations of a process according to various embodiments of the present disclosure, is issued a key from a server.

Referring to FIG. 7, according to certain embodiments of the present disclosure, a user first purchases the door lock 400, and installs a smart key application (or "App") provided by a manufacturer of the door lock 400 in the electronic device 100. The smart key App may be downloaded from the server 300 or an App store managed by the manufacturer of the door lock 400.

Alternatively, and according to certain other embodiments of the present disclosure, the door lock manufacturer may request user information (for instance, a phone number) for registration to the user at the time of door lock purchasing, and by using the user information, may provide a link capable of downloading the smart key App to the user through a push mail or SMS.

The user may run the smart key App in the electronic device 100 (S701), and register a serial number of the door lock 400 (S703). The serial number may be displayed on the door lock 400 (S721), and the user may input the serial number displayed on the door lock 400 to the electronic device 100, thereby registering the serial number of the corresponding door lock 400.

According to some embodiments of this disclosure, the serial number may be displayed on the door lock 400 in a QR code form. In such cases, the user may photograph a QR code of the door lock 400 with a camera of the electronic device 100, to register the serial number of the door lock 400. The QR code may include information (for instance, an address capable of downloading the smart key App, an address of the door lock manufacturer, etc.) related with the door lock 400. The serial number of the door lock 400 may correspond to field 601 of FIG. 6.

According to certain embodiments as described herein, electronic device 100 may request that the server 300 transmit a key (S705). The server 300 may transmit a key to the electronic device 100 (S731). The electronic device 100 may receive the key from the server 300 (S707).

The electronic device 100 may, depending on embodiments, acquire location information of the electronic device 100 through a location information receiving unit (for instance, a GNSS module 227 of FIG. 2) (S709), and add the location information of the electronic device 100 to the key (S711). According to at least one illustrative embodiment, the electronic device 100 may transmit the key to which the location information has been added, to the server 300, to update a key stored in the server 300.

According to some embodiments, when the door lock 400 and the electronic device 100 are adjacent with each other at a time point of registering the door lock 400, the location information of the electronic device 100 may be substantially identical with a location in which the door lock 400 has been installed.

According to some embodiments, the electronic device 100 may acquire indoor location information of the electronic device 100 by using an indoor positioning technology.

Additionally, according to certain embodiments of this disclosure, electronic device 100 may store the key to which the location information has been added in a memory (230 of FIG. 2) of the electronic device 100.

According to certain embodiments, where a plurality of door locks 400 exist, the electronic device 100 may group a plurality of keys based on location information included in the keys, and store the grouped keys in the memory of the electronic device 100.

Figure 8:
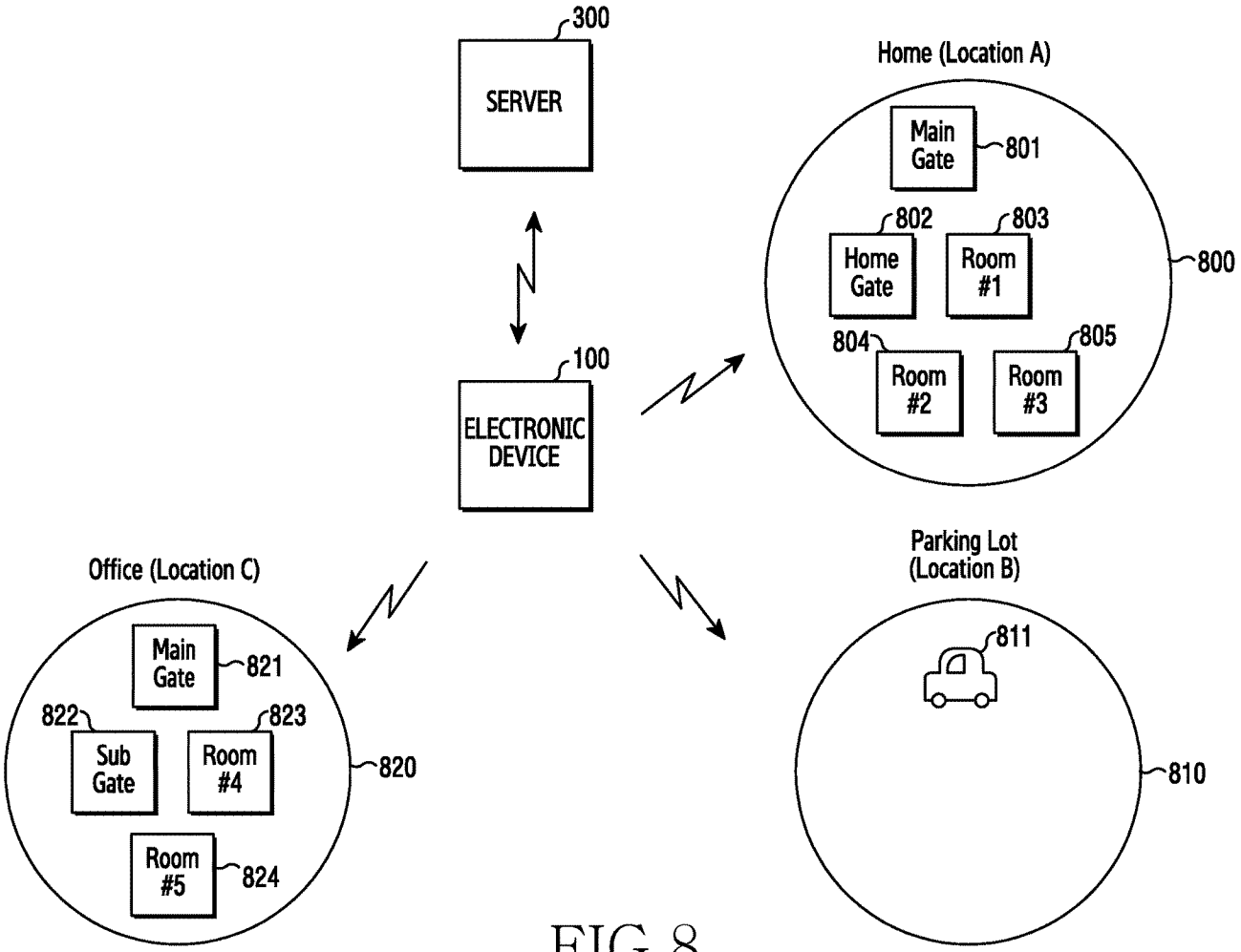
FIG. 8 illustrates an example of an electronic device registering a plurality of door locks and storing a plurality of keys in a memory of the electronic device according to various exemplary embodiments of the present disclosure.

FIG. 8 illustrates an example in which an electronic device of various exemplary embodiments registers a plurality of door locks and stores a plurality of keys in a memory of the electronic device.

FIG. 9 illustrates an example of the key stored in the memory of the electronic device according to various embodiments of this disclosure.

Below, a description is made with reference to FIG. 8 and FIG. 9.

According to certain embodiments of this disclosure, electronic device 100 may register a plurality of door locks installed in various locations 800, 810 and 820, and receive a plurality of keys from a server 300, and store the keys in the memory of the electronic device 100.

For example, the door locks 801, 802, 803, 804 and 805 may be installed in a home 800 of a user. For description convenience, a description is made assuming that location information on the home 800 is 'A'.

In some embodiments, the user may run a smart key App in the electronic device 100 to register the door lock 801, and receive a key 651 for the door lock 801 from the server 300. The electronic device 100 may add the location information 'A' to the key 651, and store the resultant key 651 in the memory of the electronic device 100. Through the same process, the electronic device 100 may register the door locks 802, 803, 804 and 805, and receive keys 652, 653, 654 and 655 from the server 300, and add the location information 'A' to the keys 652, 653, 654 and 655, and store the resultant keys 652, 653, 654 and 655 in the memory of the electronic device 100. The electronic device 100 may group the keys 651, 652, 653, 654 and 655 including the same location information 'A' into a group 'HOME'.

The user may move to a parking lot 810 while carrying the electronic device 100, to register a car door lock 811, and receive a key 656 for the door lock 811 from the server 300. The electronic device 100 may add location information 'B' of the parking lot 810 to the received key 656 and store the resultant key 656 in the memory of the electronic device 100. According to an embodiment form, the key 656 for the car door lock 811 may be provided to the user by a car seller or manufacturer without a separate registration process.

In the non-limiting example of FIG. 9, the user moves to an office 820, and runs a smart key App in the electronic device 100, and registers a door lock 821, and receives a key 657 for the door lock 821 from the server 300. For description convenience, it may be assumed that location information of the office 820 is 'C'. The electronic device 100 may add the location information 'C' to the key 657 and store the resultant key 657 in the memory of the electronic device 100. Through the same process, the electronic device 100 may register the door locks 822, 823 and 824, and receive the keys 658, 659 and 660 from the server 300, and add the location information 'C' to the keys 658, 659 and 660 and store the resultant keys 658, 659 and 660 in the memory of the electronic device 100. The electronic device 100 may group the keys 657, 658, 659 and 660 including the same location information 'C' into a group 'Office'.

Figure 10:
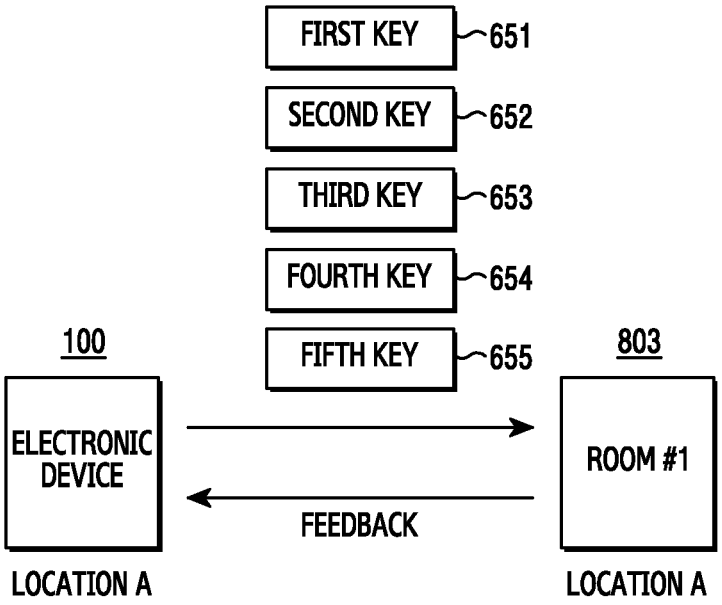
FIG. 10 illustrates an example wherein an electronic device according to various exemplary embodiments of the present disclosure unlocks a door lock in a location A.

FIG. 10 illustrates an example of an electronic device unlocking a door lock that is in a location A according to various embodiments of the present disclosure.

For convenience of description, and without limiting the scope of the present disclosure, in the non-limiting example of FIG. 10, it may be assumed that the plurality of keys shown in FIG. 9 have been stored in a memory of the electronic device.

Referring to FIG. 10, according to certain embodiments, the electronic device 100 may transmit a key to the door lock 803 via the communication module. The electronic device 100 and the door lock 803 may be in the location A. For description convenience, it may be assumed that credential data of the door lock 803 is '34512'.

If a user approaches the door lock 803 and runs a smart key App in the electronic device 100, the electronic device 100 may extract the keys 651 to 655 including the location information 'A' among the plurality of keys (600 of FIG. 9) stored in the memory of the electronic device 100.

The electronic device 100 may transmit the extracted plurality of keys 651 to 655 to the door lock 803 sequentially.

According to some embodiments of the present disclosure, a processor of the electronic device 100 may transmit, to the door lock 803, the first key 651 among the keys 651 to 655 extracted from the memory of the electronic device 100. The door lock 803 may extract a credential '12345' from the transmitted first key 651, and compare the extracted credential '12345' with a credential '34512' stored in the door lock 803. As the comparison result, they do not match with each other and therefore, the door lock 803 may transmit, to the electronic device 100, feedback information notifying that unlocking has failed. According to an embodiment form, when the unlocking has failed, the door lock 803 may transmit no feedback information. For example, when the unlocking has succeeded, the door lock 803 may output a predetermined melody by sound or output blue light. When the unlocking has failed, the door lock 803 may output another melody by sound or output red light.

In some embodiments, electronic device 100 may receive a sound from the door lock 803 and if it is determined that the unlocking of the door lock 803 has failed by analyzing the received sound, transmit the second key 652 to the door lock 803. The door lock 803 may extract a credential '23451' from the transmitted second key 652 and compare the extracted credential '23451' with the credential '34512' stored in the door lock 803. As the comparison result, they do not match with each other and therefore, the door lock 803 may transmit, to the electronic device 100, feedback information notifying that the unlocking operation has failed.

Additionally, the electronic device 100 may receive sound from the door lock 803, and if it is determined that the unlocking of the door lock 803 has failed by analyzing the received sound, transmit a third key 653 to the door lock 803. The door lock 803 may extract a credential '34512' from the transmitted third key 653 and compare the extracted credential '34512' with the credential '34512' stored in the door lock 803. If it is determined that they match with each other as the comparison result, the door lock 803 may transmit, to the electronic device 100, feedback information notifying that the unlocking has succeeded.

According to certain embodiments of the present disclosure, electronic device 100 may receive sound from the door lock 803, and analyze the received sound, and determine that the unlocking of the door lock has succeeded, and thereafter discontinue transmission of fourth key 654 and the fifth key 655.

According to various embodiments of this disclosure, the electronic device 100 may transmit only credential data included in the key to the door lock 803 as well.

Figure 11:
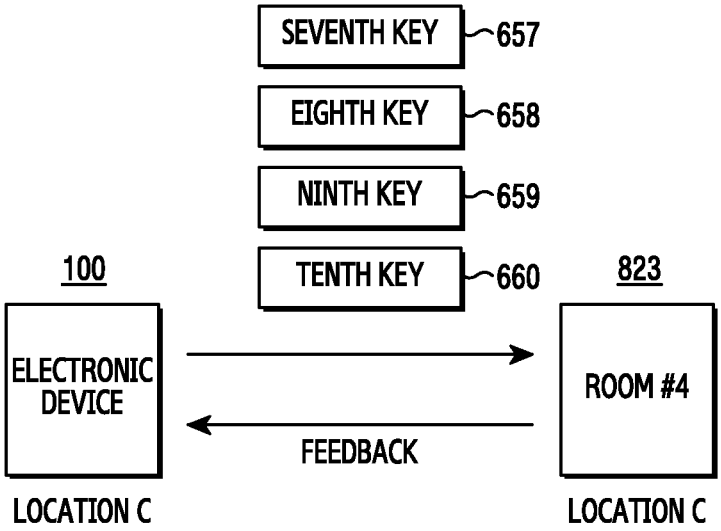
FIG. 11 illustrates an example wherein an electronic device according to various exemplary embodiments of the present disclosure unlocks a door lock in a location C.

FIG. 11 illustrates of an electronic device unlocking a door lock that is in a location C according to various embodiments of the present disclosure.

For convenience of description, it may be assumed that for the purposes of describing the non-limiting example of FIG. 11, the plurality of keys shown in FIG. 9 have been stored in the memory of the electronic device 100.

Referring to FIG. 11, according to certain embodiments of the present disclosure, the electronic device 100 may transmit a key to the door lock 823 via the communication module. The electronic device 100 and the door lock 823 may be in the location C. For convenience of description and without intending to limit the scope of the present disclosure, it may be assumed that credential data of the door lock 823 is '15432'.

If a user approaches the door lock 823 and runs a smart key App in the electronic device 100, the electronic device 100 may extract the keys 657 to 660 including the location information 'C' among the plurality of keys (600 of FIG. 9) stored in the memory of the electronic device 100.

According to certain embodiments, electronic device 100 may transmit the extracted plurality of keys 657 to 660 to the door lock 823 sequentially.

In some embodiments, a processor of the electronic device 100 may transmit, to the door lock 823, the seventh key 657 among the keys 657 to 660 extracted from the memory of the electronic device 100. The door lock 823 may extract a credential '32154' from the transmitted seventh key 657 and compare the extracted credential '32154' with the credential '15432' stored in the door lock 823. As the comparison result, they do not match with each other and therefore, the door lock 823 may transmit, to the electronic device 100, feedback information notifying that the unlocking attempt has failed. According to at least one embodiment, the door lock 823 may transmit no feedback information when the unlocking has failed. For example, when the unlocking has succeeded, the door lock 823 may output a predetermined melody by sound or output blue light. When the unlocking has failed, the door lock 823 may output another melody by sound or output red light.

According to certain embodiments, electronic device 100 may receive light from the door lock 823, and if it is determined that the unlocking of the door lock 823 has failed by analyzing the received light, transmit the eighth key 658 to the door lock 823. The door lock 823 may extract a credential '21543' from the transmitted eighth key 658 and compare the extracted credential '21543' with the credential '15432' stored in the door lock 823. As the comparison result, they do not match with each other and therefore, the door lock 823 may transmit, to the electronic device 100, feedback information notifying that the unlocking has failed.

In some embodiments, electronic device 100 may receive light from the door lock 823, and if it is determined that the unlocking of the door lock 823 has failed by analyzing the received light, transmit the ninth key 659 to the door lock 823. The door lock 823 may extract a credential '15432' from the transmitted ninth key 659 and compare the extracted credential '15432' with the credential '15432' stored in the door lock 823. If it is determined that they match with each other as the comparison result, the door lock 823 may transmit, to the electronic device 100, feedback information notifying that the unlocking has succeeded.

The electronic device 100 may receive light from the door lock 823, and analyze the received light, and determine that the unlocking of the door lock 823 has succeeded, and thereafter discontinue transmission of the tenth key 660.

According some embodiments according to this disclosure, the electronic device 100 may transmit only credential data included in the key to the door lock 823.

Figure 12:
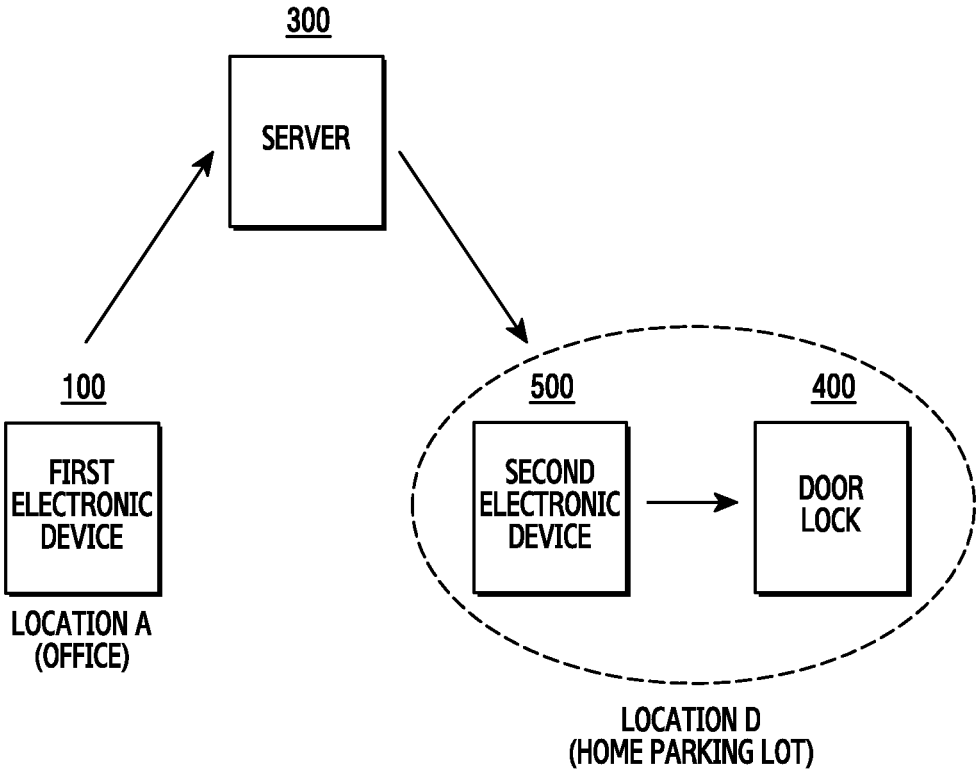
FIG. 12 illustrates an example in which an electronic device according to various exemplary embodiments of the present disclosure shares a key with an electronic device in another location.

FIG. 12 illustrates an example of an electronic device sharing a key with an electronic device being in another location according to certain embodiments of this disclosure.

For convenience of description, the non-limiting example of FIG. 12 illustrates a scenario in which a user being in an office transmits, to a courier, a key capable of opening a trunk of a car parked in a home.

According to certain embodiments, first electronic device 100 is an electronic device of a user, and is located in the office.

A second electronic device 500 is an electronic device of a courier. The second electronic device 500 is adjacent to the door lock 400. The door lock 400 has been installed in the trunk of the car parked in the home.

If a user runs a smart key App in the first electronic device 100 and then selects an object for 'key sharing', a UI for inputting information on a person who will share a key may be displayed on a screen of the first electronic device 100. If the user inputs the information (for instance, a phone number, a use period and authority) of the person who will share the key in the first electronic device 100 and requests sharing, the first electronic device 100 may add the inputted information to a key stored in the memory of the first electronic device 100 and transmit the resultant key to the server 300.

For example, if the user selects the key 656 among the plurality of keys (600 of FIG. 9) stored in the memory of the first electronic device 100, and inputs a courier's phone number, unlocking of only a trunk, a valid period of one time, a use period of one day, etc., related information may be added to corresponding fields of the key 656.

The first electronic device 100 may, in some embodiments, add supplementary information required for sharing to the key 656, and transmit the resultant key 656 to the server 300. The server 300 may transmit the key 657 to the second electronic device 500 with reference to the courier's phone number.

According to some embodiments of this disclosure, second electronic device 500 may transmit, to the door lock 400, the key 656 received from the server 300. If the door lock 400 is unlocked normally, the second electronic device 500 may delete the received key 656 based on authority information. In the present exemplary embodiment, the valid period is one time and therefore, the second electronic device 500 may one time use the key 656 for the unlocking of the door lock 400, and delete the received key 656.

Figure 13:
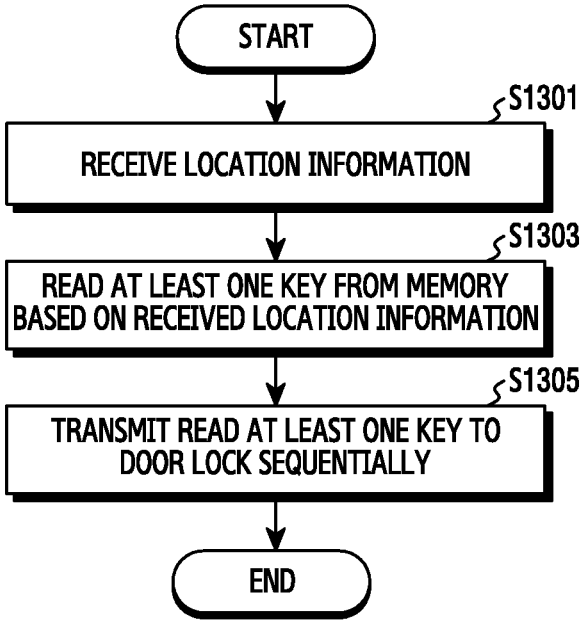
FIG. 13 illustrates, in flowchart form, operations of a method according to certain embodiments of the present disclosure, wherein an electronic device transmits a plurality of keys to a door lock sequentially.

FIG. 13 illustrates, in flowchart form, operations of a method in which an electronic device of various exemplary embodiments transmits a plurality of keys to a door lock sequentially.

According to certain embodiments of the present disclosure, electronic device 100 may receive a key capable of unlocking the door lock 400 from the server 300, and store the received key in a memory of the electronic device 100. When the door lock 400 is plural, a plurality of keys may be stored in the memory of the electronic device 100.

The electronic device 100 may receive location information of the electronic device 100 via the communication module (S1301). The communication module may, for example, include a GPS receiver. Also, the electronic device 100 may acquire the location information of the electronic device 100 by using an indoor positioning technology using a Wi-Fi network.

According to some embodiments, electronic device 100 may read a plurality of keys from the memory based on the received location information (S1303). That is, the electronic device 100 may read a key having the same location information as location information of a point where the electronic device 100 is currently being located among the plurality of keys stored in the memory. For example, while a user is in a home, a key capable of unlocking a door lock installed in the home among the plurality of keys stored in the memory may be read from the memory.

The electronic device 100 may transmit the read plurality of keys to the door lock 400 sequentially (S1305). In detail, the electronic device 100 may transmit one key to the door lock 400 and determine whether the door lock 400 has been unlocked and then, when it is determined that the door lock 400 has not been unlocked, the electronic device 100 may transmit a subsequent key to the door lock 400. After determining whether the door lock 400 has been unlocked, when it is determined that the door lock 400 has not been unlocked, the electronic device 100 may transmit a subsequent key to the door lock 400 and when the door lock 400 has been unlocked, the electronic device 100 may discontinue the transmission of a key.

Figure 14:
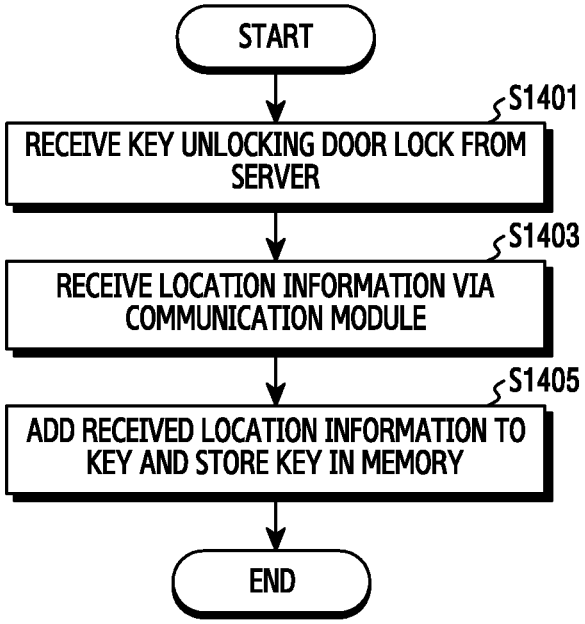
FIG. 14 illustrates, in flowchart form, operations of a method according to various embodiments of the present disclosure, wherein an electronic device of various exemplary embodiments adds location information of the electronic device to a key.

FIG. 14 illustrates, in flowchart format, operations of a method in which an electronic device adds location information of the electronic device to a key according to certain embodiments of this disclosure.

According to certain embodiments, electronic device 100 may receive a key for unlocking a door lock from the server 300 (S1401). When a user registers the door lock by using the electronic device 100, the electronic device 100 may send a request for the key to the server 300, and receive the key from the server 300. The user may run, for instance, a smart key App so as to register the door lock, and receive the key capable of unlocking the door lock. The smart key App may guide the user to input a specific number displayed on the door lock. If the user inputs the specific number, the smart key App may transmit the inputted specific number to the server 300. The server 300 may complete user authentication and then, transmit the key capable of unlocking the corresponding door lock to the electronic device 100 of the user. According to an embodiment form, information required for the user authentication may be provided to the door lock in a QR code or bar code form. In this case, the user may enable a camera of the electronic device and photograph a QR code or bar code, to extract the information required for the authentication and transmit the extracted information to the server 300. The server 300 may receive the authentication information from the electronic device 100 and then, transmit the key capable of unlocking the corresponding door lock to the electronic device 100 of the user.

According to some embodiments of this disclosure, electronic device 100 may receive location information of the electronic device 100 via the communication module (S1403). The electronic device 100 may add the received location information to the key and store the resultant key in the memory of the electronic device 100 (S1405). The electronic device 100 may receive the key from the server 300 and then, add the location information received via the communication module to the field 615 of the key of FIG. 6, and store the resultant key including the field 615 in the memory. When the user has registered a plurality of door locks in the above method, a plurality of keys corresponding to the plurality of door locks may be stored in the memory of the electronic device 100.

Figure 15:
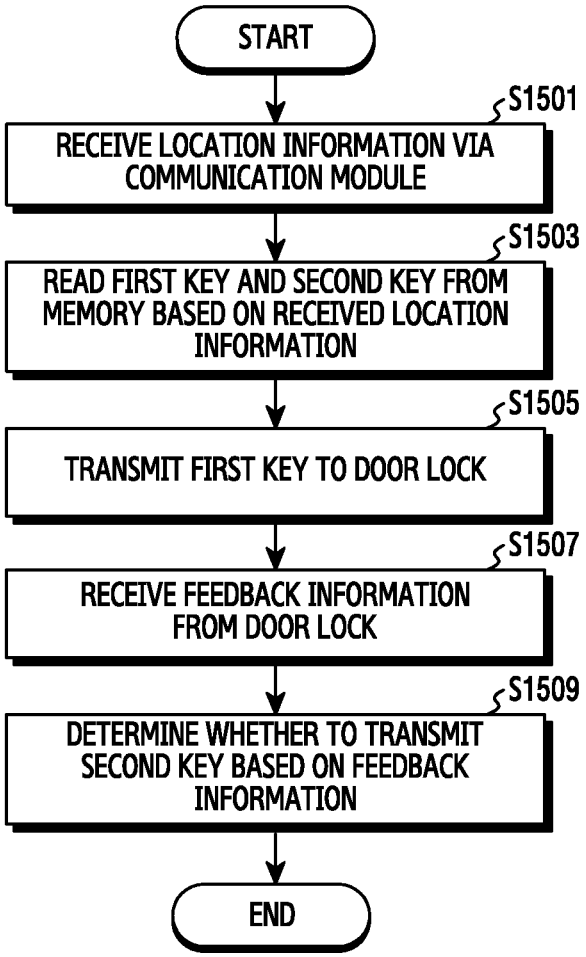
FIG. 15 illustrates, in flowchart form, operations of a method according to various embodiments of the present disclosure, wherein an electronic device determines whether to transmit keys to a door lock sequentially according to feedback information received from the door lock.

FIG. 15 illustrates, in flowchart format, operations of a method according to certain embodiments of this disclosure, wherein an electronic device determines whether to transmit keys to a door lock sequentially according to feedback information received from the door lock.

According to some embodiments, when a user has registered a plurality of door locks, a plurality of keys corresponding to the plurality of door locks may be stored in a memory of the electronic device 100. When the user runs a smart key App in order to unlock a specific door lock, the electronic device 100 may receive location information of the electronic device 100 through a communication module (S1501).

If the location information of the electronic device 100 is received, the electronic device 100 may read a first key and a second key from the memory of the electronic device 100 based on the received location information of the electronic device 100 (S1503). For example, in a case where ten keys have been stored in the memory of the electronic device 100, and two keys (i.e., the first key and the second key) have location information corresponding to location information of a point where the door lock 400 is located, the electronic device 100 may read the first key and second key having the same location information as the door lock 400 from the memory of the electronic device 100. The electronic device 100 may first transmit, to the door lock 400, the first key among the first key and second key read from the memory (S1505). After transmitting the first key, the electronic device 100 may receive feedback information from the door lock 400 (S1507). For example, the electronic device 100 may receive sound, light or signal generated from the door lock 400 and determine the unlocking or locking of the door lock 400.

In some embodiments, electronic device 100 may determine whether to transmit the second key to the door lock 400 based on the feedback information (S1509). The electronic device 100 may receive and analyze sound generated from the door lock 400. If it is determined that the door lock 400 has been unlocked normally, the electronic device 100 may not transmit the second key to the door lock 400. Additionally, if it is determined that the door lock 400 has not been unlocked as a result of analyzing the sound generated from the door lock 400, the electronic device 100 may transmit the second key to the door lock 400. According to at least one embodiment, when the door lock 400 has not been unlocked, the door lock 400 may not output separate feedback information. In this case, if a specified time lapses after transmission of the first key, the electronic device 100 may automatically transmit the second key to the door lock 400, even though the feedback information is not received from the door lock 400.

The term "module" used in the present document may include a unit consisting of hardware, software or firmware and, for example, may be used interchangeably with the terms "logic", "logic block", "component", "circuit" or the like. The "module" may be an integrally configured component or the minimum unit performing one or more functions or a part thereof. The "module" may be implemented mechanically or electronically and, for example, may include an application-specific integrated circuit (ASIC) chip, field-programmable gate arrays (FPGAs) or a programmable logic device, which has been known or will be developed in future, performing some operations. At least a part of an apparatus (e.g., modules or functions thereof) or method (e.g., operations) according to various embodiments may, for example, be implemented by an instruction that is stored in a computer-readable storage media in the form of a program module. In case where the instruction is executed by a processor (e.g., the processor 120), the processor may perform a function corresponding to the instruction. The computer-readable recording media may include a hard disk, a floppy disk, a magnetic media (e.g., a magnetic tape), an optical recording media (e.g., a compact disc-read only memory (CD-ROM) or a DVD), a magneto-optical media (e.g., a floptical disk), an internal memory, etc. The instruction may include a code that is made by a compiler or a code that is executable by an interpreter. The module or program module according to various embodiments may include at least one or more of the aforementioned constituent elements, or omit some, or further include another constituent element. Operations carried out by the module, the program module or the another constituent element according to various embodiments may be executed in a sequential, parallel, repeated or heuristic manner, or at least some operations may be executed in different order or be omitted, or another operation may be added.

An electronic device according to various exemplary embodiments of the present disclosure may select and read keys having the same location information as a location where a door lock is installed among a plurality of keys stored in a memory of the electronic device, and transmit the read keys to the door lock sequentially, thereby unlocking the door lock even without separate key selection of a user.

Also, when receiving feedback information from the door lock and determining that the door lock is unlocked, the electronic device may unlock the door lock quickly by discontinuing key transmission.

Although the present disclosure has been described with respect to one or more exemplary embodiments, various changes and modifications may be suggested to one skilled in the art. It is intended that the present disclosure encompass such changes and modifications as fall within the scope of the appended claims.

What is claimed is:

1. An electronic device comprising:
a memory;
a communication module; and
a processor electrically coupled to the memory and the communication module,
wherein the processor is configured to:
acquire information on a location of the electronic device,
identify one or more keys corresponding to the location among a plurality of keys stored in the memory, wherein the plurality of keys respectively corresponds to a plurality of locations of the electronic device, and
transmit the one or more keys to a door lock sequentially.

2. The electronic device of claim 1, wherein the processor is further configured to:
transmit a first key among the one or more keys to the door lock,
receive feedback information corresponding to the first key from the door lock,
determine whether to transmit to the door lock, a second key among the one or more keys, subsequent to the first key based on the received feedback information.

3. The electronic device of claim 2, further comprising a microphone configured to receive sound,
wherein the processor is further configured to:
receive sound generated from the door lock as the feedback information via the microphone, and
determine whether to transmit the second key based on the received sound.

4. The electronic device of claim 2, further comprising a sensor module configured to receive light,
wherein the processor is further configured to:
receive light emitted from the door lock as the feedback information via the sensor module, and
determine whether to transmit the second key based on the received light.

5. The electronic device of claim 2, wherein the processor is further configured to:
receive a signal from the door lock as the feedback information via the communication module, and
determine whether to transmit the second key based on the received signal.

6. The electronic device of claim 1, wherein a key among the one or more keys comprises first data, and
wherein the processor is further configured to utilize the key among the one or more keys for unlocking a door lock among a plurality of door locks based on the first data.

7. The electronic device of claim 1, wherein a key among the one or more keys comprises second data, and
wherein the processor is further configured to determine a valid period of the key based on the second data.

8. The electronic device of claim 1, wherein the communication module comprises a magnetic secure transmission (MST) module, and
wherein the processor is further configured to transmit a key among the one or more keys to the door lock via the MST module.

9. The electronic device of claim 1,
wherein the communication module is further configured to perform communication with a server; and
wherein the processor is further configured to:
receive a key for unlocking a door lock from the server via the communication module, and
store, in the memory, the key to which the location is added.

10. An electronic device comprising:
a communication module;
a memory; and
a processor electrically coupled to the memory and the communication module,
wherein the processor is configured to:
acquire information on a location of the electronic device,
identify a first key and a second key that correspond to the location among a plurality of keys stored in the memory, wherein the plurality of keys respectively corresponds to a plurality of locations of the electronic device,
transmit the first key to a door lock,
receive feedback information corresponding to the first key from the door lock, and
determine whether to transmit the second key based on the feedback information.

11. A method of an electronic device comprising:
acquiring information on a location of the electronic device using a global navigation satellite system (GNSS) module of the electronic device;
identifying one or more keys corresponding to the location among a plurality of keys stored in a memory of the electronic device, wherein the plurality of keys respectively corresponds to a plurality of locations of the electronic device; and transmitting the one or more keys to a door lock sequentially.

12. The method of claim 11, wherein transmitting the one or more keys to the door lock sequentially comprises:

transmitting a first key among the one or more keys to the door lock;

receiving feedback information corresponding to the first key from the door lock; and determining whether to transmit to the door lock, a second key among the one or more keys, subsequent to the first key based on the received feedback information.

13. The method of claim 12, wherein determining whether to transmit the second key subsequent to the first key based on the received feedback information comprises:

receiving sound generated from the door lock as the feedback information via a microphone of the electronic device; and determining whether to transmit the second key based on the received sound.

14. The method of claim 12, wherein the determining whether to transmit the second key based on the feedback information comprises:

receiving light emitted from the door lock as the feedback information via a sensor module of the electronic device; and determining whether to transmit the second key based on the received light.

15. The method of claim 12, wherein determining whether to transmit the second key based on the feedback information comprises:

receiving a signal from the door lock as the feedback information via a communication module of the electronic device; and determining whether to transmit the second key based on the received signal.

16. The method of claim 11, wherein a key among the one or more keys comprises first data, and wherein the method further comprises utilizing the key for unlocking a door lock among a plurality of door locks based on the first data.

17. The method of claim 11, wherein a key among the one or more keys comprises second data, and wherein the method further comprises determining a valid period of the key based on the second data.

18. The method of claim 11, wherein the transmitting the one or more keys to a door lock sequentially comprises transmitting the one or more keys sequentially to the door lock via a magnetic secure transmission (MST) module of the electronic device.

19. The method of claim 11, further comprising:

receiving a key for unlocking a door lock from a server; and storing, in a memory, the key to which the location is added.

20. The method of claim 11, wherein identifying the one or more keys comprises:

identifying a first key and a second key from the memory of the electronic device based on the location; and wherein transmitting the one or more keys to the door lock sequentially comprises:

transmitting the first key to the door lock;

receiving feedback information corresponding to the first key from the door lock; and determining whether to transmit the second key based on the feedback information.

* * * * *